US006428308B1

(12) United States Patent
Bird et al.

(10) Patent No.: US 6,428,308 B1
(45) Date of Patent: Aug. 6, 2002

(54) ELECTRONIC FUEL CONVERTIBILITY SELECTION

(75) Inventors: Douglas D. Bird, Little Canada; Stephen J. Kemp, Eagan, both of MN (US)

(73) Assignee: Honeywell Inc., Minneapolis, MN (US)

( * ) Notice: Subject to any disclaimer, the term of this patent is extended or adjusted under 35 U.S.C. 154(b) by 0 days.

(21) Appl. No.: 09/450,078

(22) Filed: Nov. 29, 1999

(51) Int. Cl.[7] ..... F23N 3/00

(52) U.S. Cl. ..... 431/18; 431/80; 431/90; 126/39 BA

(58) Field of Search ..... 431/12, 18, 90, 431/89, 80, 62, 78, 79; 137/113; 236/26 A; 126/39 BA, 39 R, 39 N

(56) References Cited

U.S. PATENT DOCUMENTS 4,111,637 A * 9/1978 Hillman, II ..... 431/90
4,144,997 A * 3/1979 Anderson et al. ..... 431/90
4,770,629 A * 9/1988 Bohan, Jr. ..... 431/80
4,816,987 A 3/1989 Brooks et al.
5,150,685 A 9/1992 Porter et al.
5,234,196 A * 8/1993 Harris ..... 431/355
5,769,622 A * 6/1998 Aoki et al. ..... 431/80
5,816,792 A * 10/1998 Spencer ..... 431/90
5,873,351 A 2/1999 Vars et al.

FOREIGN PATENT DOCUMENTS

| | | |
|---|---|---|
| EP | 0043256 A | 1/1982 |
| EP | 0562538 A | 9/1993 |
| JP | 01174820 | 7/1989 |
| JP | 02093206 | 4/1990 |

* cited by examiner

*Primary Examiner*—James C. Yeung

(57) ABSTRACT

An apparatus for and method for providing easy and rapid conversion from a first fuel to a second fuel in a gas appliance. The gas appliance has a variable fuel valve controlled by a microprocessor. A table stored in non-volatile memory has an entry for each of the fuels to be burned in the gas appliance. The table entries are empirically determined at the time of manufacture.

26 Claims, 5 Drawing Sheets

ELECTRONIC FUEL CONVERTIBILITY SELECTION

CROSS REFERENCE TO CO-PENDING APPLICATIONS

U.S. patent application Ser. No. 09/447,611, filed Nov. 23, 1999, and entitled, "LOW INPUT VOLTAGE, LOW COST, MICRO-POWER DC-DC CONVERTER"; U.S. patent application Ser. No. 09/447,999, filed Nov. 23, 1999, and entitled, "STEPPER MOTOR DRIVING A LINEAR ACTUATOR OPERATING A PRESSURE CONTROL REGULATOR"; U.S. patent application Ser. No. 09/448,102, filed Nov. 23, 1999, and entitled, "LOW INPUT VOLTAGE, HIGH EFFICIENCY, DUAL OUTPUT DC TO DC CONVERTER"; and U.S. patent application Ser. No. 09/448,000, filed Nov. 23, 1999, and entitled, "ELECTRONIC DETECTING OF FLAME LOSS BY SENSING POWER OUTPUT FROM THERMOPILE" are commonly assigned co-pending applications incorporated herein by reference.

BACKGROUND OF THE INVENTION

1. Field of the Invention

The present invention generally relates to systems for control of a gas appliance incorporating a flame and more particularly relates to fuel control valve systems.

2. Description of the Prior Art

It is known in the art to employ various appliances for household and industrial applications which utilize a fuel such as natural gas (i.e., methane), propane, or similar gaseous hydrocarbons. Typically, such appliances have the primary heat supplied by a main burner with a substantial pressurized gas input regulated via a main valve. Ordinarily, the main burner consumes so much fuel and generates so much heat that the main burner is ignited only as necessary. At other times (e.g., the appliance is not used, etc.), the main valve is closed extinguishing the main burner flame.

A customary approach to reigniting the main burner whenever needed is through the use of a pilot light. The pilot light is a second, much smaller burner, having a small pressurized gas input regulated via a pilot valve. In most installations, the pilot light is intended to burn perpetually. Thus, turning the main valve on provides fuel to the main burner which is quickly ignited by the pilot light flame. Turning the main valve off, extinguishes the main burner, which can readily be reignited by the presence of the pilot light.

These fuels, being toxic and highly flammable, are particularly dangerous in a gaseous state if released into the ambient. Therefore, it is customary to provide certain safety features for ensuring that the pilot valve and main valve are never open when a flame is not present preventing release of the fuel into the atmosphere. A standard approach uses a thermogenerative electrical device (e.g., thermocouple, thermopile, etc.) in close proximity to the properly operating flame. Whenever the corresponding flame is present, the thermocouple generates a current. A solenoid operated portion of the pilot valve and the main valve require the presence of a current from the thermocouple to maintain the corresponding valve in the open position. Therefore, if no flame is present and the thermocouple(s) is cold and not generating current, neither the pilot valve nor the main valve will release any fuel.

In practice, the pilot light is ignited infrequently such as at installation, loss of fuel supply, etc. Ignition is accomplished by manually overriding the safety feature and holding the pilot valve open while the pilot light is lit using a match or piezo igniter. The manual override is held until the heat from the pilot flame is sufficient to cause the thermocouple to generate enough current to hold the safety solenoid. The pilot valve remains open as long as the thermocouple continues to generate sufficient current to actuate the pilot valve solenoid.

The safety thermocouple(s) can be replaced with a thermopile(s) for generation of additional electrical current. This additional current may be desired for operating various indicators or for powering interfaces to equipment external to the appliance. Normally, this requires conversion of the electrical energy produced by the thermopile to a voltage useful to these additional loads. Though not suitable for this application, U.S. Pat. No. 5,822,200, issued to Stasz; U.S. Pat. No. 5,804,950, issued to Hwang et al.; U.S. Pat. No. 5,381,298, issued to Shaw et al.; U.S. Pat. No. 4,014,165, issued to Barton; and U.S. Pat. No. 3,992,585, issued to Turner et al. all discuss some form of voltage conversion.

Upon loss of flame (e.g., from loss of fuel pressure), the thermocouple(s) ceases generating electrical current and the pilot valve and main valve are closed, of course, in keeping with normal safety requirements. Yet this function involves only a binary result (i.e., valve completely on or valve completely off). Though it is common within vehicles, such as automobiles, to provide variable fuel valve control as discussed in U.S. Pat. No. 5,546,908, issued to Stokes, and U.S. Pat. No. 5,311,849, issued to Lambert et al., it is normal to provide static gas appliances with a simple on or off, linearly actuated valve having the desired safety features.

Yet, there are occasions when it is desirable to adjust the valve outlet pressure regulation point of the main burner supply valve of a standard gas appliance. These include changes in mode (i.e., changes in the desired intensity of the flame) and changes in the fuel type (e.g., a change from propane to methane). U.S. Pat. No. 5,234,196, issued to Harris; U.S. Pat. No. 4,816,987, issued to Brooks et al.; U.S. Pat. No. 5,873,351, issued to Vars et al.; and U.S. Pat. No. 5,150,685, issued to Porter et al., suggest approaches to variable valve positioning of a gas appliance. However, the introduction of an entirely new valve design is likely to introduce severe regulatory difficulties. The present safety valve approach has been used for such a long time with satisfactory results. Proof of safe operation of a new approach to valve design would require substantial costly end user testing.

SUMMARY OF THE INVENTION

The present invention overcomes the disadvantages of the prior art by providing a main burner valve for a gas appliance which offers the user the opportunity to quickly and easily change the main valve outlet pressure regulation point to accommodate changes in fuel type. The main burner valve of the present invention utilizes a standard, linearly actuated valve design having proven safety features, but which also offers precisely controllable differing outlet pressure. Linear actuation is important, because it offers the normal safety features associated with the industry standard of full off upon flame out. However, because the valve of the present invention may be positioned along the entire length of its travel from full open to full closed, the valve is totally adjustable permitting changes in mode, fuel input, and other outlet pressure related features.

In accordance with the preferred mode of the present invention, a thermopile is thermally coupled to the pilot flame. As current is generated by the thermopile, it is converted via a DC-to-DC converter to a regulated output and an unregulated output. The regulated output powers a microprocessor and other electronic circuitry which control operation of the main fuel valve in response to sensed conditions, operator inputs, and certain stored data. The unregulated output powers various mechanical components including a stepper motor.

The stepper motor is mechanically coupled to a linear actuator which precisely positions the main fuel valve. Because the main fuel valve is linearly actuated, it operates in known fashion with respect to the industry proven flame out safety features. Yet, the stepper motor, under direct control of the microprocessor, positions the linear actuator for precise valve positioning and therefore, fuel input modulation to the burner.

The use of a stepper motor means that any selected valve position is held statically by the internal rachet action of the stepper motor without quiescent consumption of any electrical energy. That makes the electrical duty cycle of the stepper motor/valve positioning system extremely low. This is a very important feature which permits the system to operate under the power of the thermopile without any necessary external electrical power source. In fact, the stepper motor duty cycle is sufficiently low, that the power supply can charge a capacitor slowly over time such that when needed, that capacitor can power the stepper motor to change the position of the linear actuator and hence the main fuel valve outlet pressure regulation point.

In accordance with the present invention, the gas appliance is calibrated during the manufacturing process. The stepper motor values and hence the valve positioning data corresponding to the desired valve settings are determined empirically for the various fuel types. This information is stored within non-volatile memory of the microprocessor. Thus, a table of stepper motor commands are available to the microprocessor for rapid changes of fuel type.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
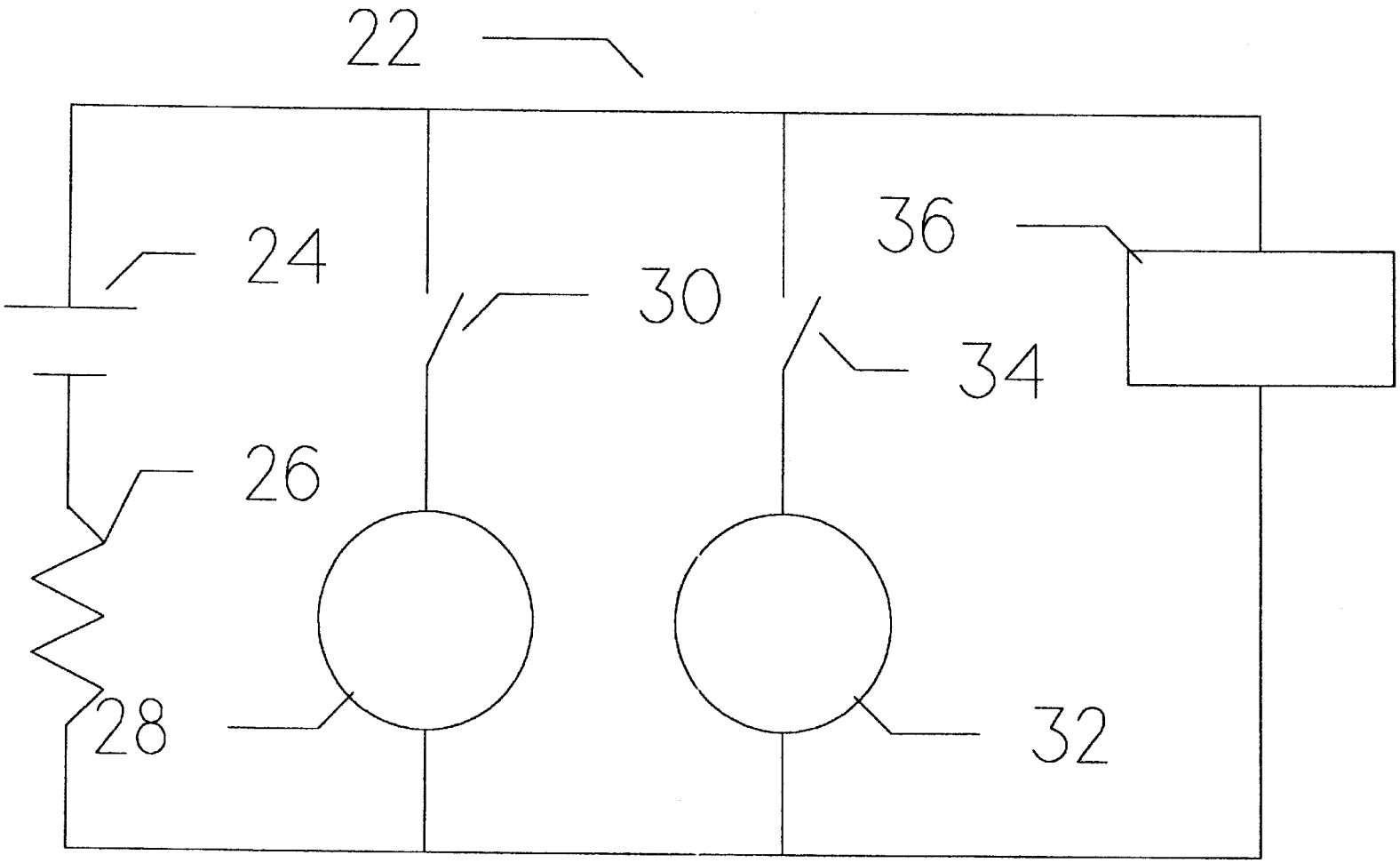
FIG. 1 is a simplified electrical schematic diagram of the present invention.

FIG. 1 is a very basic electrical diagram 22 of the power circuitry of the present invention. Thermopile 24 is structured in accordance with the prior art. Resistor 26 represents the internal resistance of thermopile 24.

Pilot valve 28 has a solenoid (not separately shown) which holds the pilot valve closed whenever sufficient current flows through the circuit. Similarly, the internal solenoid (also not separately shown) main valve 32 holds the main valve closed whenever sufficient current flows through the associated circuit.

DC-to-DC conversion facility 36 converts the relatively low voltage output of thermopile 24 to a sufficiently large voltage to power the electronic circuitry, including the microprocessor. In accordance with the preferred mode of the present invention, DC-to-DC conversion facility 36 consists of two DC-to-DC converters. The first converter operates at the extremely low thermopile output voltages experienced during combustion chamber warm up to generate a higher voltage to start the higer efficiency, second DC-to-DC converter. The other DC-to-DC converter, once started, can keep converting at much lower input voltage and generate much more power from the limited thermopile output for the system during normal operation. A more detailed description of the second device is available in the above identified and incorporated, commonly assigned, co-pending U.S. Patent Applications.

Figure 2:
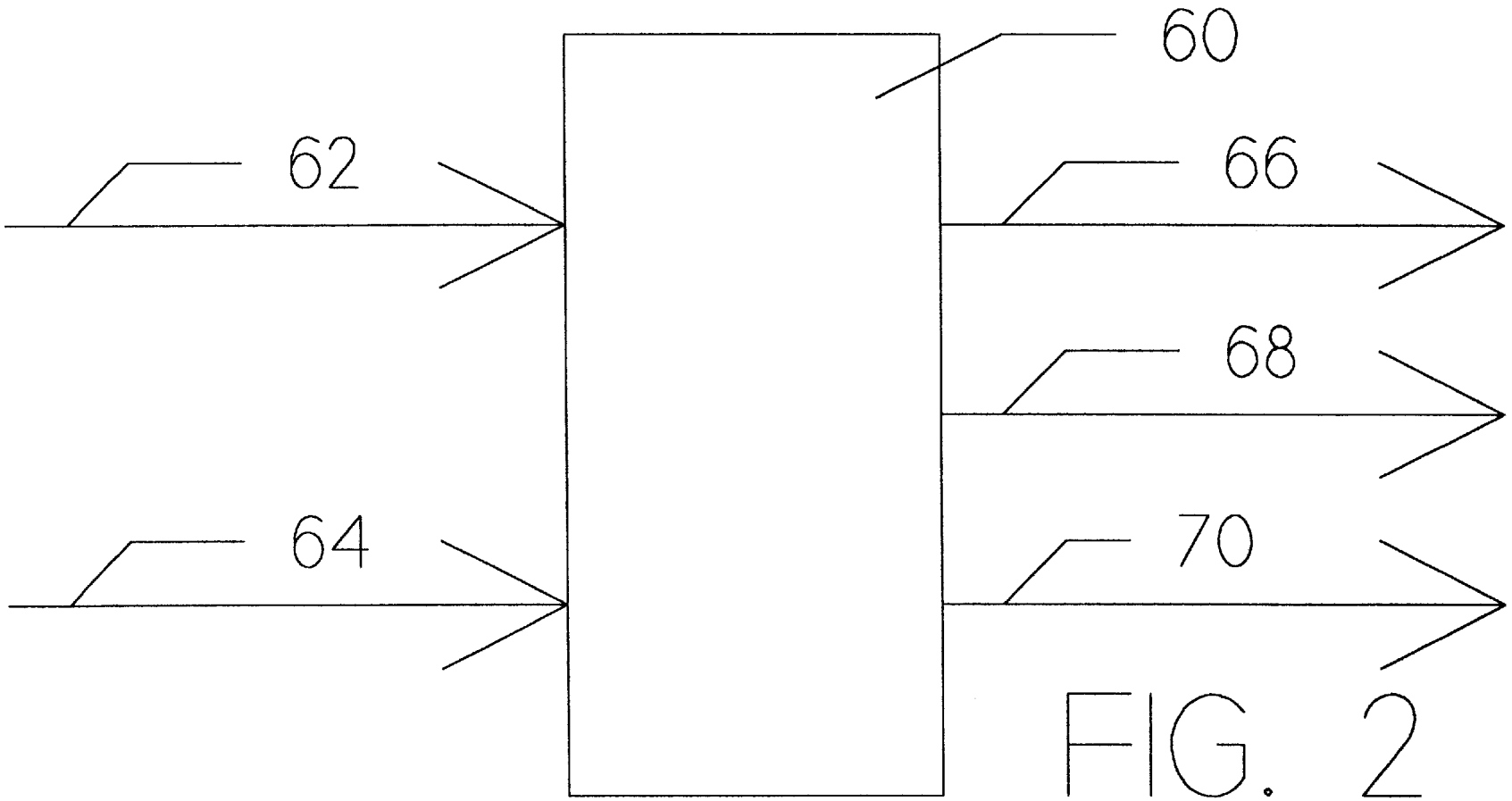
FIG. 2 is a simplified block diagram of the microprocessor of the present invention.

FIG. 2 is a simplified diagram showing the basic inputs and outputs of microprocessor 60. In the preferred mode, microprocessor 60 is an 8-bit AVR model AT90LS8535 microprocessor available from ATMEL. It is a high performance, low power, restricted instruction set (i.e., RISC) microprocessor. In the preferred mode, microprocessor 60 is clocked at one megahertz to save power, even though the selected device may be clocked at up to four megahertz.

The two primary inputs to microprocessor 60 are the thermopile output voltage received via input 62 and the manual mode change information received via input 64. The thermopile output voltage is input once per second. The mode change information, on the other hand, is received a periodically in response to manual action by the user.

Output 66 controls operation of the stepper motor. As is explained in more detail below, this affects management of the main fuel valve orifice size. Output 68 is the on/off control for the external circulation fan. Output 70 controls the radio frequency receiver through which an operator can communicate via a remote control device.

Figure 3:
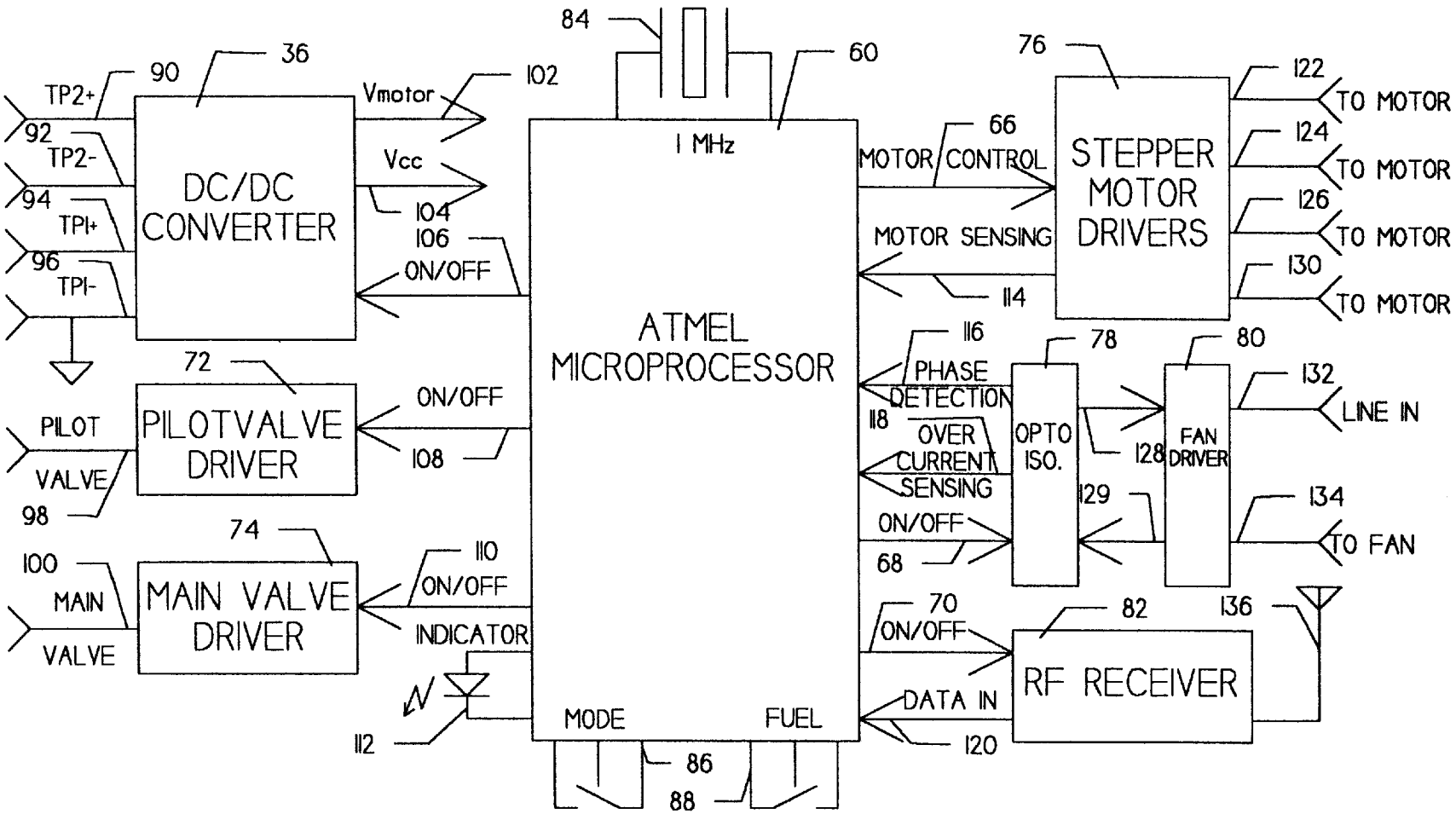
FIG. 3 is a detailed electrical block diagram.

FIG. 3 is a detailed block diagram of the inputs and outputs of microprocessor 60. One megahertz crystal 84 clocks microprocessor 60. The output of crystal 84 is also divided down to provide an interrupt to microprocessor 60 once per second. This interval is utilized for sampling of the thermopile output voltage Indicator 112 permits early notification of flame on to the user.

Manual mode switch 86 permits an operator to select local mode or remote mode. Similarly, manual switch 88 is used to select the input fuel type, so that the main valve outlet pressure regulation point can be switched between propane and methane. Each of these alternative switch positions cause microprocessor 60 to consult a particular corresponding entry within the valve positioning table stored in the non-volatile memory of microprocessor 60. These entries provide the necessary information for microprocessor 60 to direct the stepper motor to set the main burner valve outlet pressure to the proper value. The method for determining the valve positioning table entries is described in detail below.

DC-to-DC converter 36 can receiver inputs from up to two thermopiles. Inputs 94 and 96 provide the positive and negative inputs from the first thermopile, whereas inputs 90 and 92 provide the positive and negative inputs from the second thermopile, respectively. Output 102 is the unregulated output of DC-to-DC converter 36. This output has a voltage varying between about 6 volts and 10 volts. The unregulated output powers the mechanical components, including the stepper motor. Line 104 is a 3 volt regulated output. It powers microprocessor 60 and the most critical electronic components. Line 106 permits microprocessor to power DC-to-DC converter 36 up and down. This is consistent with the voltage sampling and analysis by microprocessor 60 which predicts flame out conditions.

Line 72 enables and disables pilot valve driver 72 coupled to the pilot valve via line 98. Similarly, line 110 controls main valve driver 74 coupled to the main valve via line 100. This is important because microprocessor 60 can predict flame out conditions and shut down the pilot and main valves long before the output of the thermopile is insufficient to hold the valves open. A more detailed description of this significant feature may be found in the above referenced, co-pending, commonly assigned, and incorporated U.S. Patent Applications.

Stepper motor drivers 76 are semiconductor switches which permit the output of discrete signals from microprocessor 60 to control the relatively heavy current required to drive the stepper motor. In that way, line 66 controls the stepper motor positioning in accordance with the direction of the microprocessor firmware. Line 114 permits sensing of the stepper motor status. Lines 122, 124, 126, and 130 provide the actual stepper motor current.

In the preferred mode of practicing the present invention, the gas appliance is a fireplace. The thermopile output is not sufficient to power the desired fan. However, the system can control operation of the fan. Therefore, line 132 provides the external power which is controlled 15 by fan driver 80. Lines 128 and 129 couple to optical isolation device 78 for coupling via lines 68, 116, and 118 to microprocessor 60. Line 134 actually powers the fan.

The fireplace of the preferred mode also has radio frequency remote control. A battery operated transmitter communicates with rf receiver 82 via antenna 136. Lines 70 and 120 provide the interface to microprocessor 60. Rf receiver 82 is powered by the 3 volt regulated output of DC-to-DC converter 36 found on line 104.

Figure 4:
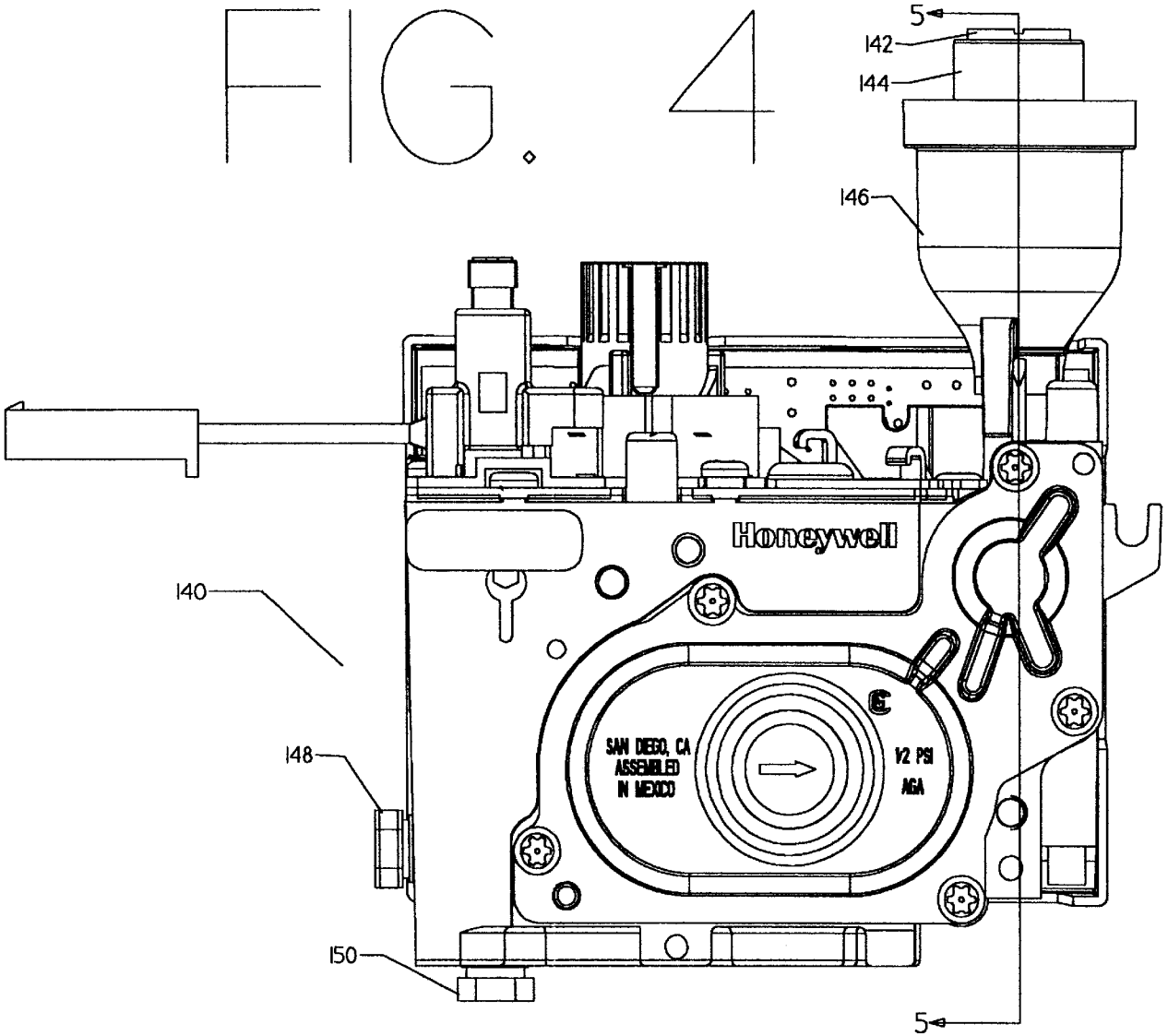
FIG. 4 is a plan view of the valve assembly.

FIG. 4 is a plan view of the valve assembly 140 of the preferred mode of the present invention. Fuel inlet 150 has standard fittings. Similarly, gas outlet 148 includes a standard coupling. Regulator cap 142 fits within housing cap 144 as shown (a better view is found in the section of FIG. 5). Motor housing 146 contains the linear actuator and stepper motor (neither shown in this view).

Figure 5:
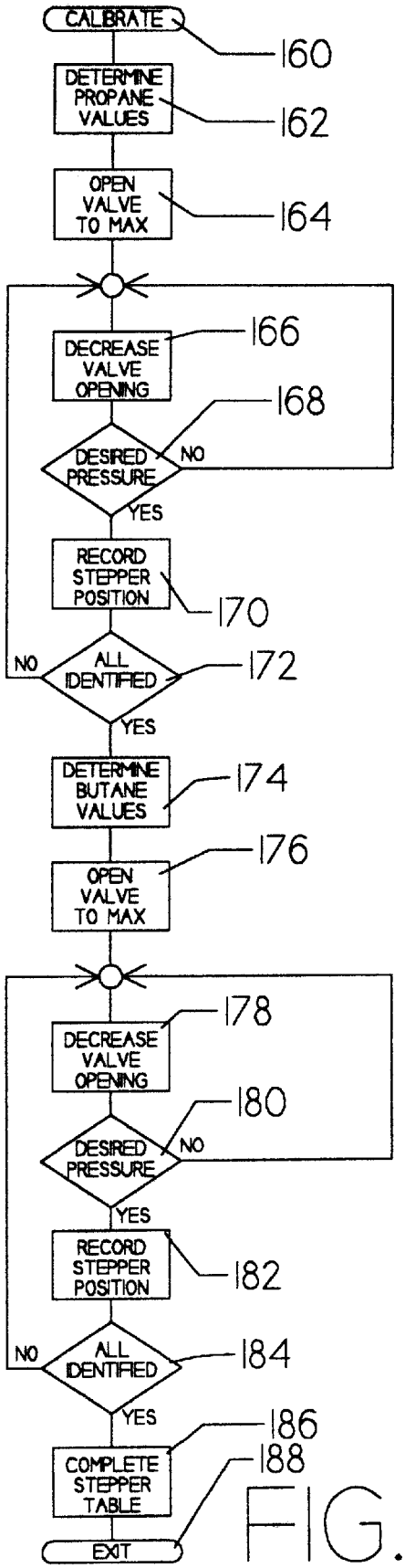
FIG. 5 is a flow diagram showing calibration of the valve assembly.

FIG. 5 is a flow diagram showing the manner in which the entries are empirically determined for the valve positioning table. Entry is via element 160. The propane valve positioning values are determined first. The stepper motor opens the valve to its maximum position at element 164.

At element 166, the stepper motor decrements the outlet pressure of the valve. The outlet pressure is determined at element 168. If the pressure is not as desired, control is returned to element 166 for a further decrement of the outlet pressure. When the valve pressure has been decremented to the desired point, control is given by element 168 to element 170. The stepper motor positioning command is stored in the valve positioning table by element 170. Element 72 determines whether there are other propane entries to be determined. If yes, control is given to element 166 to continue the process.

After element 172 finds that all of the propane entries have been made in the valve positioning table, control is given to element 174 to initialize for determine the methane (or natural gas) values. The process is essentially repeated for methane. Element 176 opens the valve to the maximum outlet pressure. Decrementation of the valve outlet pressure is accomplished by element 178. Element 180 determines if the desired value has been reached. If no, the process continues at element 178. If yes, element 182 records the stepper motor value. Element 184 ascertains whether all of the methane values have been determined. If not, control is given to element 178. If yes, element 186 completes the valve positioning table, and exit is made via element 188.

Having thus described the preferred embodiments of the present invention, those of skill in the art will be readily able to adapt the teachings found herein to yet other embodiments within the scope of the claims hereto attached.

We claim:

1. In a gas appliance having a flame produced by a main burner configured to burn at least two different types of fuels wherein said flame of said main burner is controlled by a main valve and having a second flame produced by a second burner coupled to a one of said two different types of fuels, the improvement comprising:

a. a current generation device; and b. a switch powered by said current generation device which changes said main valve from a first fuel source to a second fuel source by electrically modifying said main valve from a first predetermined outlet pressure to a second predetermined outlet pressure.

2. The improvement according to claim 1 further comprising an electronic circuit powered by said current generation device for controlling the position of said main valve.

3. The improvement according to claim 2 wherein said electronic circuit further comprises a microprocessor powered by said current generation device.

4. The improvement according to claim 3 wherein said further microprocessor further comprises non-volatile memory.

5. The improvement according to claim 4 wherein said non-volatile memory stores a first quantity corresponding to said first predetermined outlet pressure and a second quantity corresponding to said second predetermined outlet pressure.

6. The improvement according to claim 5, wherein the first and second quantities stored by the non-volatile memory relate to valve positioning.

7. The improvement according to claim 6, wherein the first and second quantities stored by the non-volatile memory are stepper motor values.

8. An apparatus comprising:

a. a flame;

b. a gas inlet;

c. a gas outlet;

d. a valve having a variable outlet pressure interposed between said gas inlet and said gas outlet; and e. an electrical device powered by said flame responsively coupled to said valve which controllably varies said outlet pressure from a first predetermined value to a second predetermined value.

9. An apparatus according to claim 8 wherein said electrical device further comprises a microprocessor.

10. An apparatus according to claim 9 wherein said microprocessor further comprises a non-volatile memory.

11. An apparatus according to claim 10 wherein said non-volatile memory contains a first quantity corresponding to said first predetermined value and a second quantity corresponding to said second predetermined value.

12. An apparatus according to claim 11 wherein said first quantity corresponds to propane and said second quantity corresponds to methane.

13. The improvement according to claim 11 including an actuator coupled to the valve for positioning the valve, wherein the first and second quantities stored by the non-volatile memory relate to positioning the actuator.

14. The improvement according to claim 13, including a stepper motor for positioning the actuator, wherein the first and second quantities stored by the non-volatile memory are stepper motor values.

15. A method of facilitating conversion of fuel type within a gas appliance having a valve with an adjustable outlet pressure comprising:

a. initializing calibration of said valve for a first fuel type;

b. changing said adjustable outlet pressure;

c. determining if outlet pressure of said valve is a desired value;

d. if said determining step determines no, repeating steps b and c; and e. if said determining step determines yes, storing a quantity corresponding to said outlet pressure.

16. A method according to claim 15 further comprising:

a. repeating steps b through e for each of a plurality of desired values.

17. A method according to claim 16 further comprising:

a. reinitializing calibration of said valve for a second fuel type and repeating steps b through e.

18. A method according to claim 17 wherein said first fuel type is methane.

19. A method according to claim 18 wherein said second fuel type is propane.

20. An apparatus comprising:

a. means for generating a current from a flame;

b. means for supplying a first gas;

c. means responsively coupled to said supplying means for controlling flow of said first gas; and d. means responsively coupled to said controlling means and powered by said generating means for electrically changing said flow.

21. An apparatus according to claim 20 further comprising:

a. means responsively coupled to said controlling means for supplying a second gas; and b. means responsively coupled to said electrically changing means for converting from said first gas to said second gas.

22. An apparatus according to claim 21 wherein said changing means further comprises a microprocessor.

23. An apparatus according to claim 22 wherein said converting means further comprises a non-volatile memory.

24. An apparatus according to claim 23 further comprising:

a. a first quantity corresponding to said first gas stored within said non-volatile memory; and b. a second quantity corresponding to said second gas stored within said non-volatile memory.

25. The improvement according to claim 24, wherein the flow control means includes a valve and an actuator coupled to the valve for positioning the valve, wherein the first and second quantities stored by the non-volatile memory relate to valve positioning.

26. The improvement according to claim 25, wherein the flow control means includes a stepper motor in operating relationship to the actuator, and wherein the first and second quantities stored by the non-volatile memory are stepper motor values.

* * * * *